US011946727B2

(12) United States Patent
Rovinsky

(10) Patent No.: US 11,946,727 B2
(45) Date of Patent: Apr. 2, 2024

(54) TRAJECTORY SHAPING

(71) Applicant: ISRAEL AEROSPACE INDUSTRIES LTD., Lod (IL)

(72) Inventor: Jacob Rovinsky, Modiin (IL)

(73) Assignee: ISRAEL AEROSPACE INDUSTRIES LTD., Lod (IL)

( * ) Notice: Subject to any disclaimer, the term of this patent is extended or adjusted under 35 U.S.C. 154(b) by 0 days.

(21) Appl. No.: 17/765,148

(22) PCT Filed: Oct. 8, 2020

(86) PCT No.: PCT/IL2020/051087
§ 371 (c)(1),
(2) Date: Mar. 30, 2022

(87) PCT Pub. No.: WO2021/070185
PCT Pub. Date: Apr. 15, 2021

(65) Prior Publication Data

US 2022/0325993 A1 Oct. 13, 2022

(30) Foreign Application Priority Data

Oct. 10, 2019 (IL) ..... 269920

(51) Int. Cl.
*F42B 10/66* (2006.01)
*F41F 3/04* (2006.01)
(Continued)

(52) U.S. Cl.
CPC ..... *F42B 10/668* (2013.01); *F41F 3/04* (2013.01); *F41G 7/36* (2013.01); *F42B 10/26* (2013.01)

(58) Field of Classification Search
CPC ..... F42B 10/26; F42B 10/668; F41F 3/04; F41G 7/36
See application file for complete search history.

(56) References Cited

U.S. PATENT DOCUMENTS 3,500,714 A * 3/1970 Cullinane ..... F41F 1/00 102/438
3,754,725 A 8/1973 Kartzmark et al.
(Continued)

FOREIGN PATENT DOCUMENTS

DE 4401315 A1 8/1995
DE 102015009980 A1 * 2/2017 ..... F41G 7/346
(Continued)

OTHER PUBLICATIONS

Machine Translation of DE-102015009980-A1, Graeser S, Feb. 2017 (Year: 2017).*

*Primary Examiner* — Tien Q Dinh
*Assistant Examiner* — Katherine June Bolek
(74) *Attorney, Agent, or Firm* — Dorsey & Whitney LLP

(57) ABSTRACT

The presently disclosed subject matter includes a system and a method for launching a projectile towards a target, wherein the system comprises a control circuitry, a booster engine, and one or more thrusters adapted to be connected to the projectile and capable of being spun during launch around a longitudinal axis of the projectile, the control circuitry being operatively connected to the one or more thrusters; wherein responsive to ignition of propellant stowed in a combustion chamber of the booster engine, the booster engine causes the projectile to launch from its cell; following launch of the projectile, cause the projectile to turn at a certain rate and a certain azimuth.

26 Claims, 14 Drawing Sheets

(51) Int. Cl.
*F41G 7/36* (2006.01)
*F42B 10/26* (2006.01)

(56) References Cited

U.S. PATENT DOCUMENTS

| | | | | |
|---|---|---|---|---|
| 3,946,639 | A | 3/1976 | Sanvito et al. | |
| 4,192,461 | A * | 3/1980 | Arborg | B63H 11/02 239/265.17 |
| 4,387,865 | A | 6/1983 | Howard et al. | |
| 4,745,861 | A | 5/1988 | Fenton et al. | |
| 5,238,204 | A | 8/1993 | Metz | |
| 5,695,152 | A * | 12/1997 | Levy | F41G 7/2293 244/3.13 |
| 5,823,469 | A | 10/1998 | Arkhangelsky et al. | |
| 6,565,036 | B1 * | 5/2003 | Palathingal | F41G 7/2253 244/3.17 |
| 7,851,732 | B2 | 12/2010 | Brinkerhoff et al. | |
| 7,886,519 | B2 | 2/2011 | Woessner et al. | |
| 8,058,596 | B2 | 11/2011 | Kinsey et al. | |
| 2009/0127377 | A1 * | 5/2009 | Lam | F41G 7/30 244/3.2 |
| 2011/0049289 | A1 * | 3/2011 | Kinsey, Jr. | F42B 10/661 244/3.22 |
| 2019/0023422 | A1 * | 1/2019 | Nicholson | B64G 1/1078 |

FOREIGN PATENT DOCUMENTS

| | | | | |
|---|---|---|---|---|
| EP | 1366334 | B1 * | 6/2006 | F41G 7/305 |
| GB | 1439566 | A | 6/1976 | |
| GB | 2316663 | A * | 3/1998 | B64G 1/26 |
| GB | 2316663 | A | 3/1998 | |

* cited by examiner

Example of a initial spin rate induced by a canister $t_0 \ll T_0$

Example of a projectile's velocity vector behavior during the trajectory shaping

*Red line* – activation of single thruster

Black line – sequential activation of two thrusters to the same azimuth

Example of a projectile's body angle behavior during the trajectory shaping

*Red line* – activation of single thruster
Black line – sequential activation of two thrusters to the same azimuth Examples of a projectile's velocity vector behavior during the trajectories shaping depends on different timings of two thrusters sequential activations

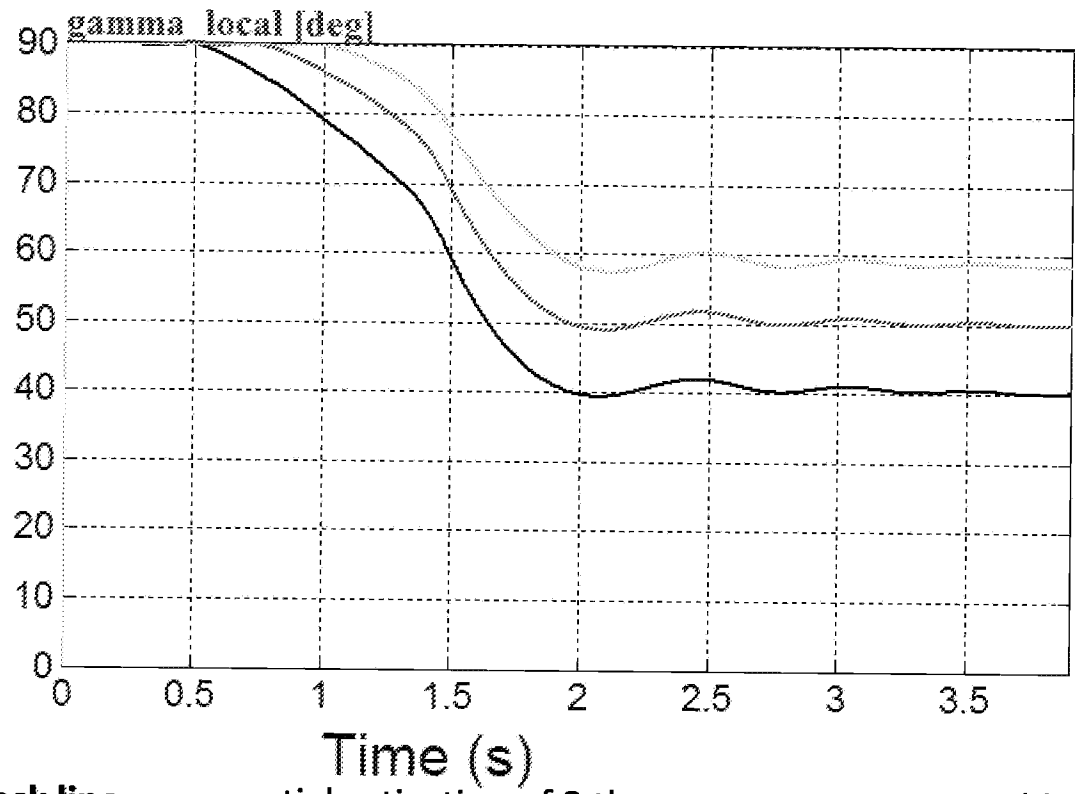

Fig. 9

Black line – sequential activation of 2 thrusters as soon as possible
Red line – sequential activation of 2 thrusters at the second opportunity
Green line – sequential activation of 2 thrusters at the third opportunity

TRAJECTORY SHAPING

BACKGROUND

A vertical launching system (VLS) is a launching system where a projectile, such as a missile or a rocket (referred to herein collectively as "projectiles"), is stored in a cell (also referred to as a "canister") and launched in an upward (substantially vertical) direction. Once in the air, the projectile trajectory is shaped to fly in a desired direction, e.g., in the direction of a designated target.

A vertical launching system has various advantages, one related to the ability to fire a projectile in any desired direction by shaping the projectile's trajectory after it is ejected from its cell. Another advantage is related to the fact that projectiles are stored in cells which can be placed underground (or below deck in a ship or vehicle), and thus accommodate less area above ground (or on deck), and are also more protected from being damaged.

GENERAL DESCRIPTION

The presently disclosed subject matter includes a launching system and method that enable deflection of a missile during launch in a desired deflection angle, and which do not suffer from various shortcomings of known systems.

The disclosed system and method are applicable for trajectory shaping (or bending), not only for VLS applications, but also for shaping of a projectile trajectory sideways, in the horizontal plane rather than the vertical plane. For example, such capability is beneficial for quick hitting of time critical targets (TCT) by Multiple Launch Rocket Systems (MLRS). Horizontal trajectory shaping can help to save critical time, which is otherwise needed for turning the launcher toward the target in MLRS.

The presently disclosed subject matter includes a system and a method for launching a projectile (e.g., a statically stable projectile) towards a target, wherein the system comprises a control circuitry, a booster engine, and one or more thrusters adapted to be connected to the projectile and capable of being spun during launch around a longitudinal axis of the projectile, the control circuitry being operatively connected to the one or more thrusters;

wherein, responsive to ignition of propellant stowed in a combustion chamber of the booster engine, the booster engine causes the projectile to launch from its cell; following launch of the projectile, the control circuitry is configured to activate one or more thrusters that cause the projectile to turn at a certain rate and a certain azimuth.

The disclosed subject matter further includes the following aspects:

According to one aspect of the presently disclosed subject matter there is provided a system for launching a projectile towards a target, the system comprising:

a control circuitry, a booster engine, and one or more thrusters adapted to be connected to the projectile and capable of being spun during launch around a longitudinal axis of the projectile, the control circuitry being operatively connected to the one or more thrusters;

wherein, responsive to ignition of propellant stowed in a combustion chamber of the booster engine, the booster engine is configured to launch the projectile; wherein ignition of the propellant initiates a sequential execution of a first burning phase, a second burning phase, and a third burning phase; wherein the thrust generated during the second burning phase is lower than the thrust generated during the first and the third burning phases;

the control circuitry is configured to activate during a second burning phase the one or more thrusters; wherein, upon the activation, the projectile begins to turn in a certain deflection azimuth.

In addition to the above features, the system according to this aspect of the presently disclosed subject matter can optionally comprise one or more of features (i) to (xxv) below, in any desired combination or permutation:

i. Wherein during the first burning phase the projectile is ejected from a cell in a manner that causes the one or more thrusters to spin around a longitudinal axis of the projectile; wherein the control circuitry is configured to activate the one or more thrusters according to the activation timing, wherein the activation timing is calculated according to a desired deflection azimuth.

ii. Wherein activation of the one or more thrusters is executed according to a selected activation profile, wherein the activation profile is selected according to a desired deflection angle of a velocity vector of the projectile.

iii. Wherein the activation profile comprises data indicative, for each one of the one or more thrusters, a respective spin-cycle for activation.

iv. Wherein the activation profile defines for a specific combination of one or more thrusters, the activation timing of each thruster e.g., relative to the activation timing of a first thruster.

v. Wherein the projectile is ejected in a substantially vertical direction.

vi. Wherein the projectile is ejected in a non-vertical direction, and wherein in some examples, deflection angles of the projectile are defined relative to a launch direction.

vii. Wherein the one or more thrusters are fixed to the projectile such that a lever arm, relative to a center of gravity of the projectile, is created, causing a velocity vector of the projectile to turn upon activation in a certain deflection azimuth that is dependent on the timing of activation.

viii. Wherein the processing circuitry is configured to calculate the activation timing of the one or more thrusters, based on data including: the initial angular position of at least one thruster, spin rate, and a position of the target.

ix. Wherein the spin rate is measured using a gyroscope onboard the projectile.

x. Wherein the one or more thrusters include two or more thrusters, and wherein the processing circuitry is further configured, following activation of a first thruster, to update a respective activation timing of one or more additional activations of thrusters from the two or more thrusters, according to the actual deflection azimuth and deflection angle rate that result from one or more previous activations of thrusters.

xi. Wherein the system further comprises an off-board processing circuitry, external to the projectile, configured to calculate the activation timing of at least one thruster of the one or more thrusters, based on data including direction of the target and a nominal spin rate of the projectile, and nominal thrust of the one or more thrusters.

xii. Wherein the cell is designed with a spiral groove along its internal surface and the projectile comprises a pin attached to its body; wherein the projectile is stored in the cell with the pin positioned within the groove, and upon launch the projectile is pushed out of the cell while the pin is situated in the groove, causing the projectile to spin around its longitudinal axis.

xiii. Wherein the one or more thrusters are installed in a thrusters-belt fixed to the projectile in a manner allowing the belt to spin freely around the projectile separate from the projectile body; wherein the cell is designed with a spiral groove along its internal surface; the projectile comprises a pin attached to the belt; wherein the projectile is stored in the cell with the pin positioned within the groove, and, upon launch, the projectile is pushed out of the cell while the pin situated in the groove, causing the belt to spin around its longitudinal axis.

xiv. Wherein the one or more thrusters are installed in a thrusters-belt fixed to the projectile in a manner allowing the belt to spin freely around the projectile, and wherein spinning of the belt is executed by an onboard spinning mechanism operatively connected to the belt.

xv. Wherein the total thrust of the first burning phase is adapted according to a length of the cell.

xvi. Wherein the total thrust generated during the first burning phase accelerates a projectile to an ejection velocity of at least 30 meters per second.

xvii. Wherein the duration of the second burning phase is adapted according to a time needed for deflection of the velocity vector of the projectile to a desired deflection angle.

xviii. Wherein the duration of a second burning phase is at least five times longer than the duration of a first burning phase.

xix. Wherein the thrust of the second burning phase is at least two times lower than the thrust of a first burning phase.

xx. Wherein the total thrust of the first burning phase and the second burning phase accelerates the projectile to a maximal velocity which does not exceed 0.4 Mach.

xxi. Wherein the duration of the third burning phase is adapted according to a time needed for accelerating the projectile to the desired burn-out velocity.

xxii. Wherein a duration of thrust generated by any one of the one or more thrusters is shorter than duration of a thruster spin-cycle.

xxiii. Wherein a duration of thrust, generated by any one of the one or more thrusters, is shorter than a fourth of a duration of the thruster spin-cycle.

xxiv. Wherein one or more thrusters comprise a plurality of thrusters, and wherein the control circuitry is further configured, following activation of a first thruster of the plurality of thrusters to:

measure real-time data including deflection azimuth and/or deflection angle rate; compare the measured real-time data with an expected data; in case a deviation between measured data and expected data is identified, update thruster activation parameters to rectify the deviation.

xxv. Wherein the projectile is statically stable.

According to another aspect of the presently disclosed subject matter there is provided a method of launching a projectile towards a target, the method comprising:

in response to a command to launch the projectile towards a target:

igniting propellant stowed in a combustion chamber of the projectile; wherein ignition of the propellant initiates a sequential execution of a first burning phase, a second burning phase, and a third burning phase; wherein the thrust generated during the second burning phase is lower than the thrust generated the first and the third burning phases;

ejecting, during the first burning phase, the projectile out of a cell, in a manner that causes one or more thrusters fixed to the projectile circumference to spin around a longitudinal axis of the projectile;

activating, during the second burning phase, the one or more thrusters; wherein the one or more thrusters are fixed to the projectile, such that upon activation of the one or more thrusters, the projectile begins to turn in a certain deflection azimuth that is dependent on the timing of activation.

According to yet another aspect of the presently disclosed subject matter there is provided a projectile comprising a control circuitry, a booster engine, and one or more thrusters adapted to be connected to the projectile and capable of being spun during launch around a longitudinal axis of the projectile, the control circuitry being operatively connected to the one or more thrusters;

wherein, responsive to ignition of propellant stowed in a combustion chamber of the booster engine, the booster engine is configured to launch the projectile; wherein ignition of the propellant initiates a sequential execution of a first burning phase, a second burning phase, and a third burning phase; wherein the thrust generated during the second burning phase is lower than the thrust generated during the first and the third burning phases;

the control circuitry is configured to activate, during a second burning phase, the one or more thrusters; wherein, upon the activation, the projectile begins to turn in a certain deflection azimuth that is dependent on a timing of activation.

The method and projectile in accordance with the presently disclosed subject matter can optionally comprise one or more of features (i) to (xxv) listed above with respect to the system in any technically possible combination or permutation.

BRIEF DESCRIPTION OF THE DRAWINGS

In order to understand the presently disclosed subject matter and to see how it may be carried out in practice, the subject matter will now be described, by way of non-limiting examples only, with reference to the accompanying drawings, in which:

FIG. 9 is a graph plotting deflection angle as a function of thrust spin-cycles, according to some examples of the presently disclosed subject matter.

DETAILED DESCRIPTION

Figure 1A:
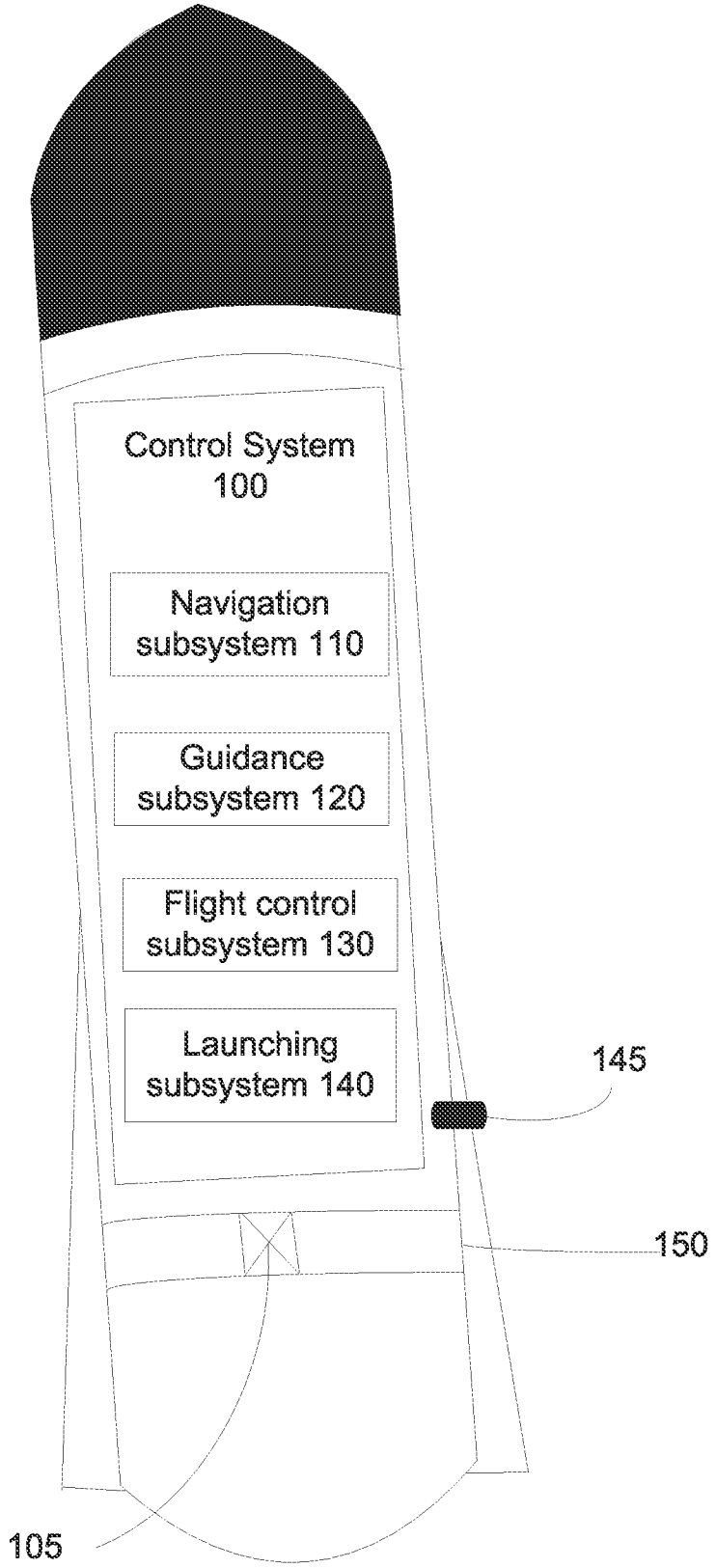
FIG. 1A is a general schematic illustration of a projectile and some of its onboard sub-systems, according to some examples of the presently disclosed subject matter.

Unless specifically stated otherwise, as apparent from the following discussions, it is appreciated that throughout the specification discussions utilizing terms such as "calculating", "determining", "activating", or the like, include action and/or processes of a computer that manipulate and/or transform data into other data, said data represented as physical quantities, e.g., such as electronic quantities, and/or said data representing physical objects.

The terms "system", "sub-system" or variations thereof should be expansively construed to include any kind of hardware electronic device with a processing circuitry, which includes (at least one) computer processing device configured and operable to execute computer instructions stored, for example, on a computer memory being operatively connected thereto. Examples of such a device include, but are not limited to: a digital signal processor (DSP), a microcontroller, a microprocessor, a field programmable gate array (FPGA), an application specific integrated circuit (ASIC), or any other electronic computing device, and/or any combination thereof.

As used herein, phrases such as "for example," "such as", "for instance" and variants thereof may be used to describe non-limiting embodiments of the presently disclosed subject matter. Reference in the specification to "one case", "some cases", "other cases", or variants thereof, means that a particular feature, structure, or characteristic, described in connection with the embodiment(s), is included in at least one embodiment of the presently disclosed subject matter. Thus, the appearance of the phrase "one case", "some cases", "other cases", or variants thereof, does not necessarily refer to the same embodiment(s).

It is appreciated that certain features of the presently disclosed subject matter, which are, for clarity, described in the context of separate embodiments, may also be provided in combination in a single embodiment. Conversely, various features of the presently disclosed subject matter, which are, for brevity, described in the context of a single embodiment, may also be provided separately or in any suitable sub-combination.

For the sake of clarity, the term "substantially" may be used herein to imply the possibility of variations in values with an acceptable range, as would be apparent to a person skilled in the art. According to one example, the term "substantially" should be interpreted to imply possible variation of up to 10% over or under any specified value. According to another example, the term "substantially" should be interpreted to imply possible variation of up to 5% over or under any specified value. According to yet another example, the term "substantially" should be interpreted to imply possible variation of up to 2.5% over or under any specified value. According to a further example, the term "substantially" should be interpreted to imply possible variation of up to 1% over or under any specified value. For example, substantially vertical, may imply the possibility of some deviation from an exact 900 angle.

Figure 3:
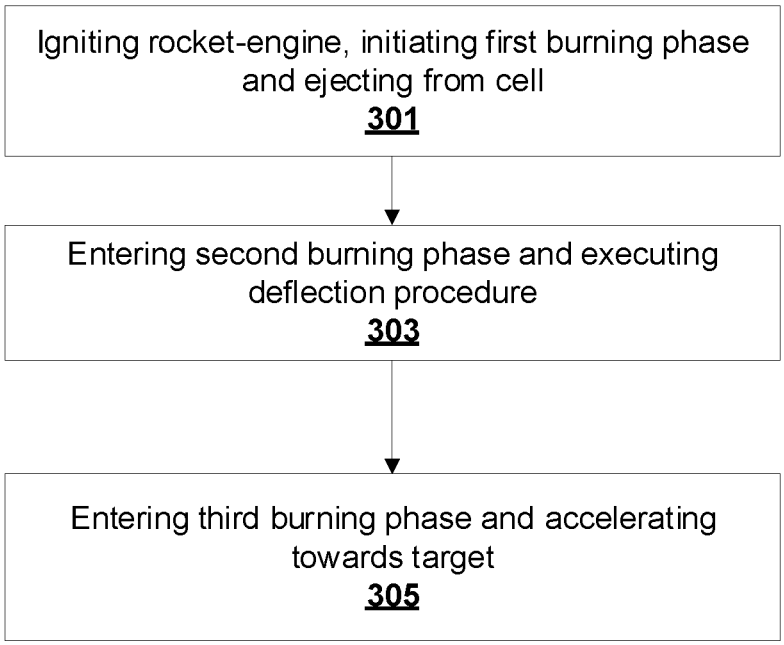
FIG. 3 is a general flowchart of operations carried out during projectile launch, according to some examples of the presently disclosed subject matter.
Figure 4A:
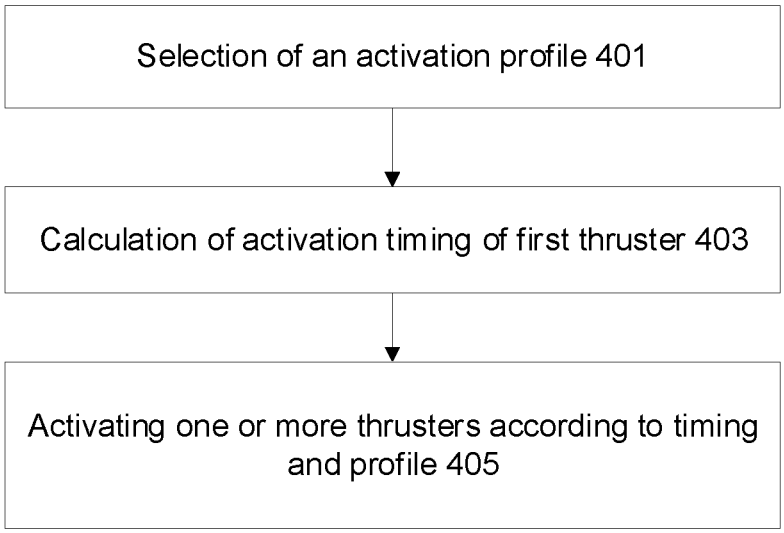
FIG. 4*a* is a flowchart of operations carried out for providing desired deflection, according to some examples of the presently disclosed subject matter.
Figure 4B:
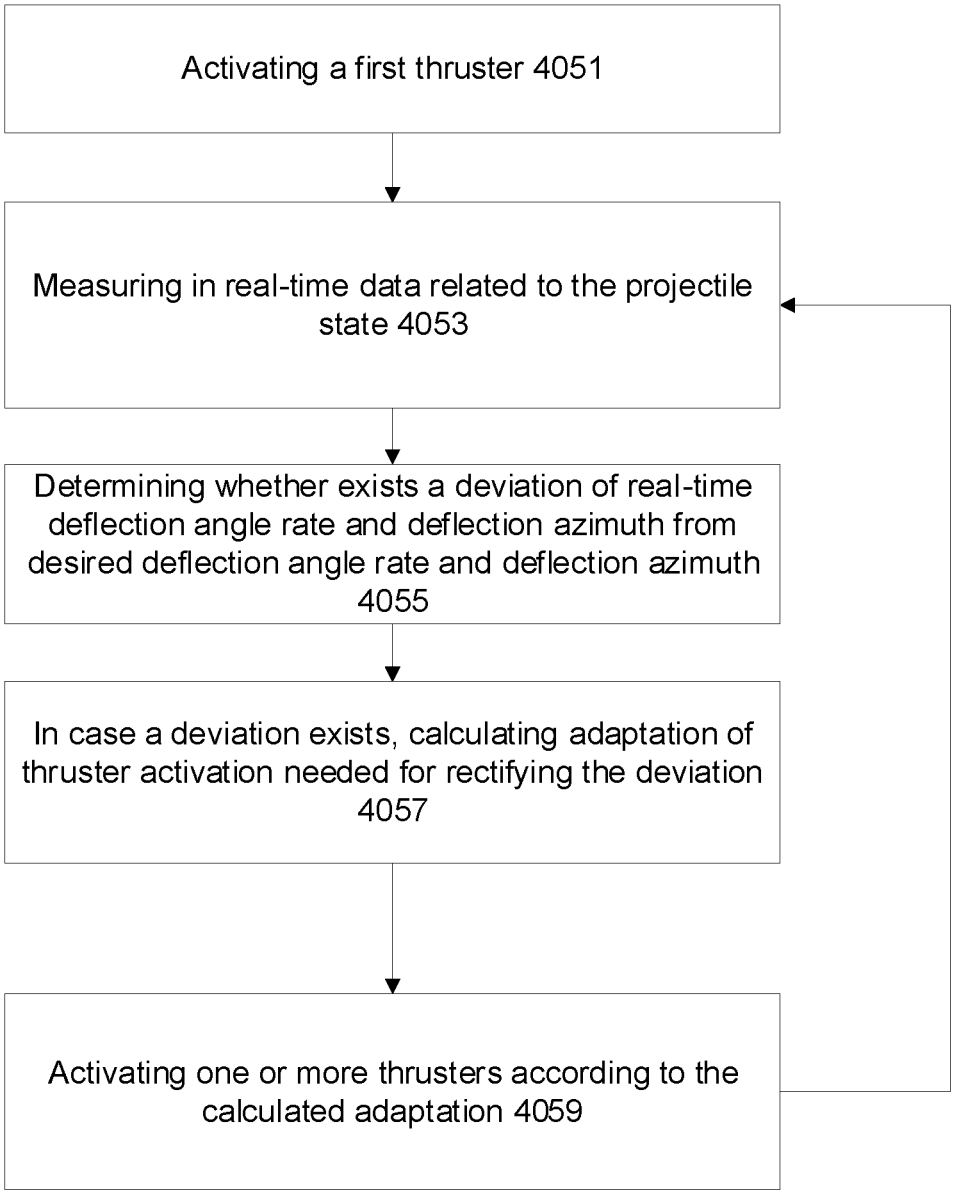
FIG. 4*b* is a flowchart of operations carried out for real-time adaptation of deflection azimuth and deflection angle rate, according to some examples of the presently disclosed subject matter.

In embodiments of the presently disclosed subject matter, fewer, more, and/or different stages than those shown in FIGS. 3, 4*a* and 4*b*, may be executed. In embodiments of the presently disclosed subject matter, one or more stages illustrated in FIGS. 3, 4*a* and 4*b*, may be executed in a different order, and/or one or more groups of cycles may be executed simultaneously. For example, the operations described with reference to block 401 can be executed simultaneously or following the operations described with reference to block 403. Some elements in FIGS. 1A and 1B can be made up of a combination of software and hardware and/or firmware that performs the functions as defined and explained herein. Functional elements in FIGS. 1A and 1B, which are drawn as a single unit, may be divided, in practice, into several units, and functional elements in FIGS. 1A and 1B which are drawn as separate units, may be consolidated, in practice, into a single unit. In some examples, part of the components of launching sub-system 140 in FIG. 1A and launching control circuitry 210 in FIG. 1B can be implemented as part of a control circuitry external to the projectile (e.g., ground electronics circuitry operatively connected to the projectile) or ground mechanical equipment. For example, engine ignition of 226 may be controlled and executed by ground electronics, and spinning mechanism 240 may be designed as part of canister 50, etc.

Bearing the above in mind, attention is now drawn to FIG. 1A showing a schematic illustration of control system 100 of a projectile, according to some examples of the presently disclosed subject matter. Control system 100 comprises navigation sub-system 110, guidance sub-system 120, flight control sub-system 130, and launching sub-system 140. According to some examples, navigation sub-system 110 is operatively connected to projectile positioning and sensing utilities, such as inertial measurement unit (IMU), and optionally to additional navigation aiding devices like a GNSS receiver, magnetometer, altimeter, etc., used for determining projectile navigation data including current position and attitude (six degree of freedom), and linear and angular velocity vectors. The projectile guidance sub-system is configured to compare real-time measured data obtained from the navigation sub-system to a desired state vector, and generate guiding instructions for guiding the projectile towards the desired target location. Guiding instructions are provided to a flight control sub-system 130 that is configured to control the projectile direction of flight according to the received instructions. The system as disclosed herein includes at least one thruster 105 attached to the projectile (e.g., installed as part of launching sub-system 140). In general, flight control system can include several additional steering mechanisms such as fins, wings, Thrust Vector Control (TVC) systems, Attitude Control Systems (ACS), Divert and Attitude Control Systems (DACS), etc.

The presently disclosed subject matter further includes, according to some examples, a projectile launching subsystem 140 configured for launching a projectile from a launching cell (otherwise known as "canister"). The launching sub-system is configured to eject the projectile from its cell (e.g., in a substantially vertical direction in VLS applications) and, following ejection, to bend (or deflect or shape) its trajectory so that the projectile points in a desired direction. Once the projectile is pointing in the desired direction, the projectile accelerates and is guided towards its target.

According to examples of the presently disclosed subject matter, launching of the projectile is performed using a three-phase thrust (booster) engine, designed to burn in three consecutive burning phases. Following activation and engine burn-out, the three burning phase engine can in some cases be separated from the front section in a multiple stage projectile configuration, or continue to fly with the front section in unified projectile configuration. The three-phases engine is designed to burn propellant stowed in the combustion chamber in a sequence of three distinct burning phases. During a short time period of the first burning phase, high pressure (e.g., 80 to 120 bar) is generated in the combustion chamber which generates, in turn, high thrust that provides the projectile with high acceleration for achieving a sufficient velocity during ejection out of the cell. During a time period of the second burning phase, lower pressure (e.g., 20 to 30 bar) and accordingly lower thrust, is generated for sufficient time needed for deflecting of the projectile velocity vector in a desired direction. According to one example, the total thrust of the second burning phase is at least two times lower than the thrust of a first burning phase. According to one example, the total thrust of the first burning phase and the second burning phase causes the projectile to accelerate to a maximal velocity which does not exceed 0.4 Mach. During the third burning phase, after the velocity vector of the projectile has been turned and the projectile is pointing in a desired direction, the engine generates high pressure (e.g., 80 to 120 bar) and accordingly high thrust, suitable for propelling the projectile in the desired direction towards the target.

Figure 2:
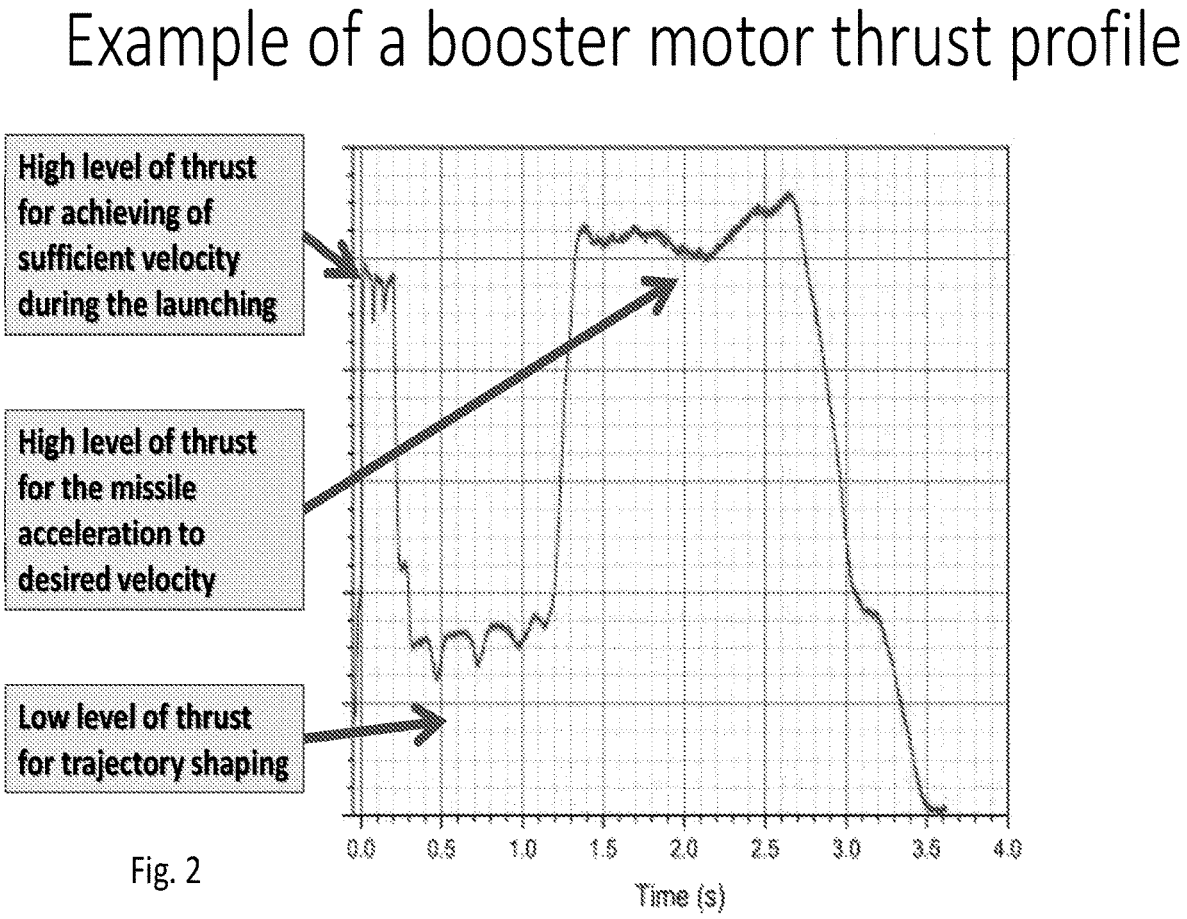
FIG. 2 is a graph plotting a thrust profile of a multiple-phase booster according to some examples of the presently disclosed subject matter.

FIG. 2 is a graph plotting a thrust profile of a three-phase booster engine according to some examples of the presently disclosed subject matter. As explained above and as shown in the graph, the thrust profile includes a sequence of three distinct phases. A first high thrust phase, which, according to the illustrated example is about 200 milliseconds long, a second low thrust phase of about 1 to 1.2 seconds long according to the illustrated example, and a third high thrust phase that starts sequentially after the second thrust phase, dedicated for providing acceleration in order to generate the desired velocity for leading the projectile to the target.

A three-phase burning profile as suggested above can be obtained in a number of ways. One way of achieving this is by designing the propellant's shape in a manner that the propellant burns differently at different time periods, thus obtaining different burning phases, each phase adapted to provide the desired thrust for a desired time period. According to some examples, the propellant designated for the first phase is designed to have a complex geometrical shape (e.g., some type of complex polyhedron) that provides a greater relative surface area to thereby increase the amount of propellant that is burnt, notwithstanding its smaller volume. The thrust and time period of the first phase is adapted for ejecting the projectile from its cell. A second part of the propellant is designed to have a smoother surface with a smaller surface area relative to the surface of area of the propellant of the first phase. Thus, following consumption of the first part of the propellant, the second part is ignited and burnt, and, due to its smoother geometry, the thrust generated during the second phase is reduced relative to the first phase. The second part of the propellant is designed to burn during a second time period and provide thrust that is suitable for allowing deflection the projectile in a desired direction. A third burning phase follows, where burning of the propellant advances towards the perimeter of the burning chamber, allowing greater amounts of propellant to burn and resulting in an increase in the generated thrust. The propellant is designed such that the engine generates acceleration, providing sufficient velocity for driving the projectile towards a target.

An alternative option for achieving a three-phase burning profile may be based on design of a propellant grain with a different chemical formulation for each phase (e.g., a slow burning rate chemical for the low level of thrust of the second phase). The different chemical can be arranged in the combustion chamber so a first type of propellant is burnt during the first phase, a second type of propellant is burnt during the second phase, and a third type of propellant is burnt during the third phase, each propellant providing the required thrust for the respective phase.

As known in the art, the burn-out velocity (and, as a result, a maximal flight distance) depends on various parameters, including the shape and weight of the projectile, the amount of propellant designated for the third burning phase, efficiency of the propellant (Isp), efficiency of the engine nozzle etc. Such parameters can be taken into consideration for the engine design as known in the art.

Figure 1B:
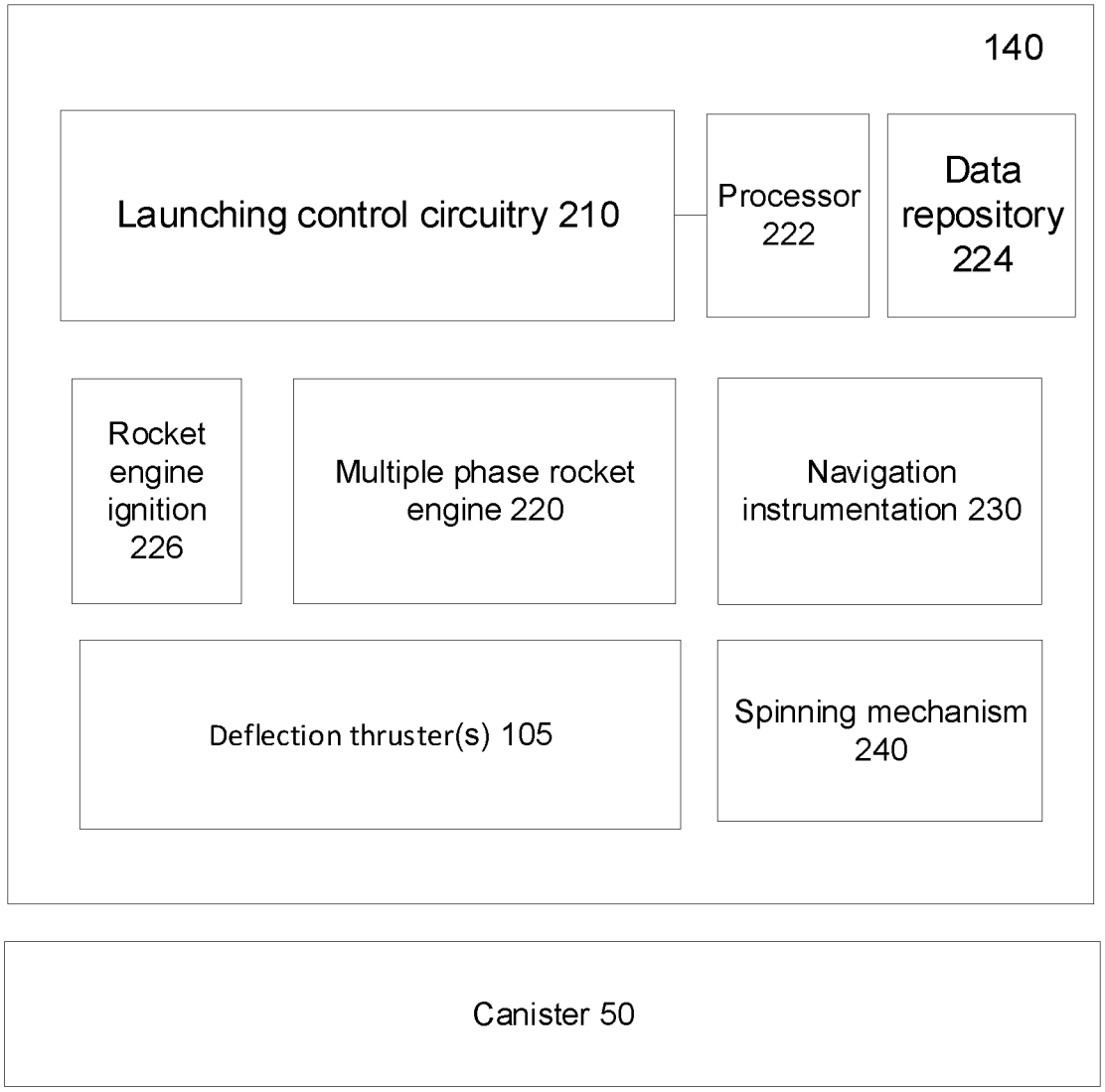
FIG. 1B is a schematic illustration of projectile launching system 140, according to some examples of the presently disclosed subject matter.

FIG. 1B is a schematic illustration of a launching sub-system 140 according to some examples of the presently disclosed subject matter. Launching sub-system 140 comprises a launching control circuitry 210 operatively connected to a multi-phase (booster) engine 220. The launching control circuitry is configured to ignite the engine (e.g., by activating engine ignition 226) in order to initiate the launching processes. In some examples, ignition of the booster engine is executed by an off-board circuitry, external to the projectile (e.g., ground control unit operatively connected to the projectile and capable of generating a command instructing to activate the igniter). As mentioned above, the launching sub-system also includes at least one deflection thruster 105 installed at a known position around the circumference of the projectile. The control circuitry 210 is further configured to control the activation of thruster 105. In some example, one or more thrusters 105 are attached around the circumference of the projectile by a circular arrangement partly or completely encircling the projectile, designed to accommodate the one or more thrusters (also referred to herein as "thrusters-belt" 150).

In general, activation of a thruster 105 creates thrust transversal to the projectile's longitudinal axis, thus loading a moment that causes the projectile to turn around its center of inertia. This moment acts for a relatively short period of time during which the moment generates angular acceleration of the projectile, and, following burn-out of the thruster 105, the projectile gains an initial angular velocity of projectile body (also referred to herein as body angle rate) resulting in a change in the projectile attitude. A thrust vector of the projectile engine follows the projectile attitude and accelerates the projectile in a direction different from the direction of ejection. During this dynamic process, a velocity vector of a projectile turns correspondingly. Notably, the angular rate of the velocity vector turns more slowly as compared to the projectile body, giving rise to an angle of attack (an angle between the projectile body and its velocity vector), and consequently this angle creates a moment of aerodynamic forces loaded on the projectile. In case of a statically stable projectile, this moment, generated by the aerodynamic forces, slows down the initial angular rate of the projectile that was created by activating of thruster 105.

As known in the art, the term "statically stable" refers to a body where center of gravity (Xcg) is maintained at a forward position relative to the center of pressure (Xcp). Generally, the location of Xcg moves forward, toward the head of the projectile, during the boost phase of the projectile, due to propellant burning and a location of center of pressure (Xcp), and depends on projectile velocity and angle of attack. The term statically stable is used herein to include a projectile that is designed to be stable for all spans of velocities and angles of attack occurring during the trajectory shaping. At later stages of the projectile flight, the aerodynamic moment increases along with the increasing velocity of the projectile, which leads to stabilization of the projectile, or in other words to alignment of the projectile body with its shaped velocity vector. As further explained below, by controllably activating at least one thruster fixed to the projectile's body, a desired trajectory can be achieved, directing the projectile to a designated target.

FIG. 3 is a flowchart showing an example of a three-phase launching process as disclosed herein. By way of example, the launching process in FIG. 3 is described below in conjunction with launching sub-system 140. However, this is done for ease of understanding only and does not mean to exclude alternative designs of a launching sub-system.

At block 301 launching is initiated and the projectile is ejected from its cell. According to some examples, launching control circuitry 210 is configured, responsive to launching command, to ignite the multi-phase engine 220 (e.g., by activating igniter 226) and initiate launch. Information indicative of the direction and range to a target, and/or information indicative of a desired azimuth and inclination angles, can be provided to a projectile, for example as part of the mission data in launching command.

In response to the ignition, a first burning phase of the engine 220 is initiated. As mentioned above, during this phase a part of the propellant is burnt in the combustion chamber that creates a high level of thrust suitable for ejecting the projectile out of its canister. A sufficiently high ejection velocity is required in order to enable ejection and to reduce sensitivity of the projectile to ambient conditions such as winds. In order to avoid deflections of the projectile trajectory by wind, the ejection velocity generally significantly exceeds current wind velocity. An example of a common ejecting velocity value is between 30-40 meters per second. The time period of the first burning phase ($T_i$) is selected to allow the projectile to develop sufficient velocity to enable safe exit from the canister. In some examples (e.g., for thrust profile shown in FIG. 2) $T_i$ is about 0.2 of a second.

As mentioned above in some examples, the projectile is ejected out of the cell in a substantially vertical position (pointing upwards). In other examples the projectile is ejected in an inclined position. This is the case for example in MLRS, where deflection as disclosed herein can be executed sideways, in a horizontal direction relative to a projectile's launch direction.

Figure 5:
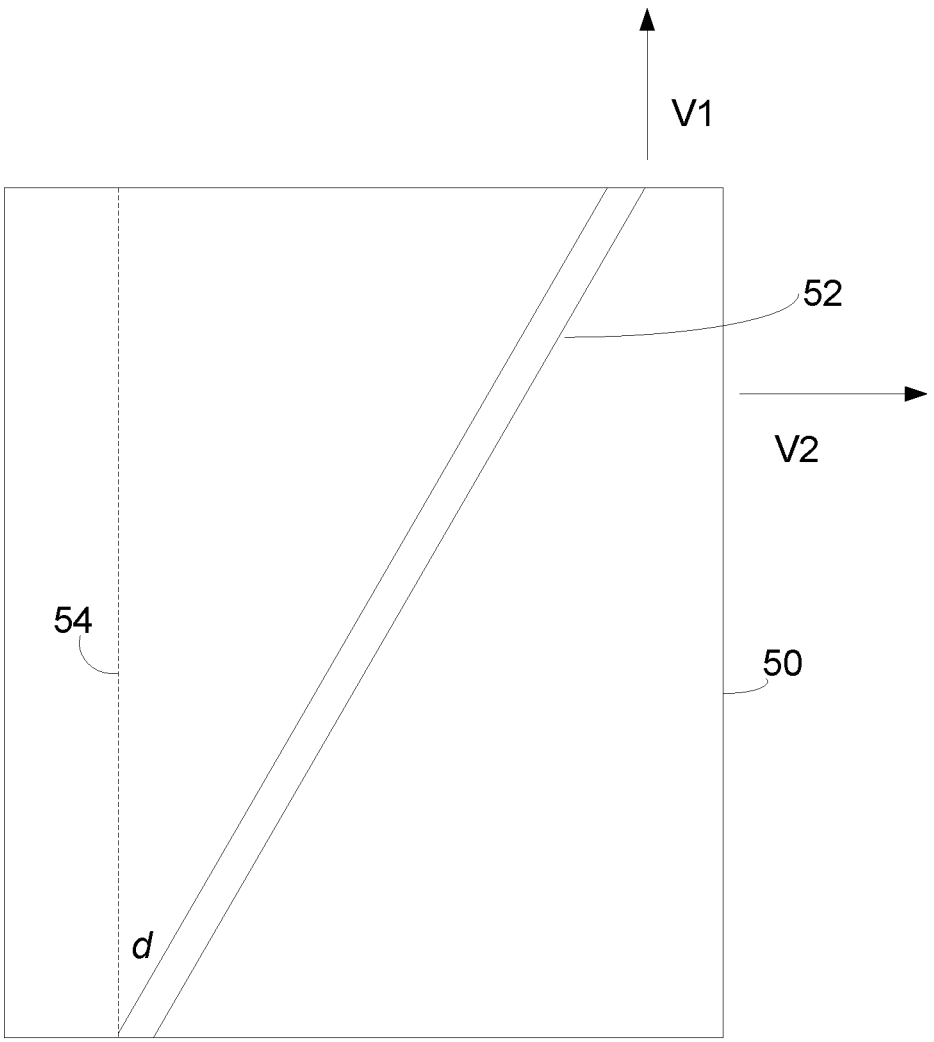
FIG. 5 is a schematic illustration of a canister internal design, according to some examples of the presently disclosed subject matter.

According to some examples of the presently disclosed subject matter, the projectile is ejected out of its cell in a manner that causes it to spin around its longitudinal axis, causing, in turn, one or more thrusters 105 to spin. In some examples, canister 50 induces a spin rate to the projectile. An example of a spinning mechanism that can be optionally used during ejection of the projectile out of its canister in order to create spinning momentum around its longitude axis is described with reference to FIG. 5. FIG. 5 shows schematically the internal surface of a canister in unrolled view. According to some examples, canister 50 is designed with spiral groove (helix) 52 along its internal surface. Notably, when the surface area of the canister is rolled into a cylinder, groove 52 assumes a helical shape, spiraling around the cylinder from bottom to top. A pin 145 (spinning pin) is firmly fixed to the projectile (e.g., at the bottom part of the projectile). The projectile is stored in the canister such that the pin 145 is positioned within the groove. Upon launch, the booster engine 220 located at the bottom of the projectile generates a propelling force, pushing the projectile out of the canister. The spinning pin 145, fixed to the projectile and situated in the groove, causes the projectile to spin while ejecting from the canister, thus creating a spinning momentum that is sustained after ejection.

Similarly, a thrusters-belt 150, connected to the projectile (e.g., using bearings to enable its spinning separately from the projectile body) can be spun by a spinning mechanism as described above with reference to FIG. 5, e.g., by fixing the spinning pin 145 to the belt, causing the belt 150 to spin while the projectile is being ejected from the cell. Alternatively, the thrusters-belt 150 can be spun by a special mechanism installed in a projectile (e.g., a servo-based mechanism). The processing circuitry can be configured to activate the spinning mechanism, e.g., before or at the onset of the second burning phase.

At block 303 in FIG. 3, a second burning phase is initiated during which a deflecting procedure of a velocity vector of the projectile (also referred to as "trajectory shaping") is executed. As explained, during ejection, one or more thrusters 105 are spun around the longitudinal axis of the projectile. As thruster 105 spins, its azimuth changes constantly. This change in azimuth enables to synchronize activation of a thruster 105 with a time where the thruster is positioned relative to the desired direction of flight such that its activation would change the projectile attitude and cause it to accelerate in the desired direction (e.g., towards the designated target).

As further explained below, according to some examples, during the second burning phase, launching control circuitry 210 is configured to control the activation timing of one or more deflection thrusters 105 according to a desired deflection azimuth and deflection angle.

The term "body deflection angle" is used herein to refer to the angle in which the projectile body is turned. Notably, the body deflection angle can be in the pitch direction and/or in the yaw direction, or in some combination of pitch and yaw directions, which can be controlled according to the activation timing of the thruster.

The term "velocity deflection angle" is used herein to refer to the angle in which the velocity vector of the projectiles is turned. Notably, the velocity deflection angle can be in any direction relative to projectile's launching direction, e.g., in azimuth and in elevation.

The term "deflection azimuth" is used herein to refer to the desired azimuth of deflection of the projectile's velocity vector, directing the projectile towards a desired direction, e.g., of a designated target.

The term "thruster activation azimuth" is used herein to refer to the azimuth of a thruster at the time of activation.

The term "thrust azimuth" is used herein to refer to the azimuth of an averaged thrust vector generated by one or more deflection thrusters. In general, it is desired that the deflection azimuth and thrust azimuth coincide. The thruster produces the thrust during its burning duration, and due to the spin of the thruster its thrust azimuth changes continuously. As explained in more detail below, the thruster activation time (which defines the thruster activation azimuth) is selected, such that the thrust azimuth and the deflection azimuth coincide as much as possible.

The time period of the second burning phase ($T_{ii}$) can be selected according to the time needed for deflection of the projectile's velocity vector in a desired deflection angle. According to some examples, the duration of a second burning phase may be between 5 to 6 times longer relative to the first burning phase (e.g., as shown in FIG. 2, the duration of second phase is about 1.2 sec, whereas the duration of the first burning phase is of about 0.2 sec).

Following deflection of the projectile velocity vector during the second burning phase and upon burn-out of thruster(s) 105, the engine continues to produce thrust aligned with the projectile body attitude, resulting in the bending of the projectile trajectory, followed by entry to a third burning phase (block 305). During this phase, the third part of the propellant is burnt, generating thrust that is sufficient for accelerating and propelling the projectile towards a designated target. The time period of the third burning phase ($T_{iii}$) can be selected according to the time needed for acceleration of the projectile to designated burn-out velocity. During this phase the projectile aligns its body deflection angles with the velocity deflection angles.

Proceeding to FIG. 4*a*, this shows a flowchart of operations carried out in order to enable deflection, according to some examples of the presently disclosed subject matter. Operations described with respect to blocks 401 and 403 can be executed, prior to or post launch. Operations described with respect to block 405 are executed as part of the second burning phase, as described with respect to block 305.

An initial activation timing of a first deflection thruster 105 is determined and an activation profile is selected (blocks 401, 403). The activation can include a sequence of relative activation timings of thrusters, additional to the first thruster, if such are available.

In general, calculation of initial activation timing and selection of an activation profile can be done based on information including mission data (including direction and range to target), nominal booster engine thrust profile, nominal spin rate of thruster, etc.

As mentioned above, an activation timing that enables to generate a thrust azimuth of thruster(s) 105 that coincides with the deflection azimuth is desired. Two factors related to the initial activation timing include the desired deflection azimuth and the deflection rate of the projectile's velocity angle, where the former prescribes the activation azimuth, and the latter prescribes the activating spin-cycle.

Calculations of activation timing can be executed onboard the projectile (by onboard processor 222), or can be otherwise executed at some other location by an off-board processing circuitry external to the projectile (e.g., ground control circuitry) and provided to a projectile e.g., as part of a mission data and stored for example in data repository 224 prior to the launch.

The initial activation timing (time of the first activation of any thruster 105) can be calculated based on the nominal spinning rate of the thruster (e.g., or the projectile, in case the entire projectile is spinning) and the initial angular position (azimuth) of the thruster before launch (e.g., stored in a data repository 224). Alternatively, if the actual spinning rate of the thruster (e.g., projectile) is known (e.g., measured by navigation sub-system 110 or launching sub-system 140 in real-time) the accuracy of calculation can be improved by taking into account real-time measured angle of the thruster. Various methods can be applied for measurement of thruster angular position.

According to one example, launching sub-system 140 comprises or is otherwise operatively connected to a gyroscope (e.g., as part of navigation instrumentations 230, which, in some examples, can be operatively connected to navigation sub-system 110 where IMU is installed) that integrates spinning rate and provides the actual (real-time) azimuth of thruster 105. Based on this information, control circuitry 210 can calculate (e.g., using processor 222) a more precise activation timing of thruster 105 in order to deflect the projectile in the desired direction.

Other methods of calculating spinning rate do not rely on a gyroscope. One such method makes use of the spinning mechanism described above with reference to FIG. 5. According to this example, control circuitry 210 is configured to calculate the spinning rate based on the exit velocity, which can be measured e.g., by navigation sub-system 110. As the projectile is spun out of its canister its velocity can be divided into two vector components $V_1$ and $V_2$ denoted in FIG. 5 by two respective arrows. $V_1$ is the linear velocity of a projectile at the time leaving of canister and $V_2$ is the tangential velocity. $V_1$ can be measured (e.g., by navigation sub-system 110) and $V_2$ can be calculated based on $V_1$ and the helix angle d (the angle between the spinning groove and line 54 that coincides with the height of the canister), as shown by equation 1:

$$v_2=v_2*\tan d$$

The spinning rate ω of the projectile is expressed by equation 2:

$$\omega r=v_2$$

where r is the radius of the contact point of the spinning pin 145 into the groove.

The spinning rate can thus be calculated by equation 3:

$$\omega>=(v_1*\tan d)/r$$

Once the spinning rate is known, the azimuth of thruster 105 can be calculated based on its initial angular position, the spinning rate, and timing.

In case a thrusters-belt 150 is spun instead of the entire projectile, in addition to gyros, the angular position of a thruster(s) relative to a projectile can be measured using any one of encoders, Hall-effect sensors, or any other known instrumentation for angle/angle rate measurements (together with the attitude of the projectile determined for example by the navigation system).

As mentioned above, activation timing is determined such that the thrusters thrust azimuth coincides with the desired deflection azimuth.

Figure 6A:
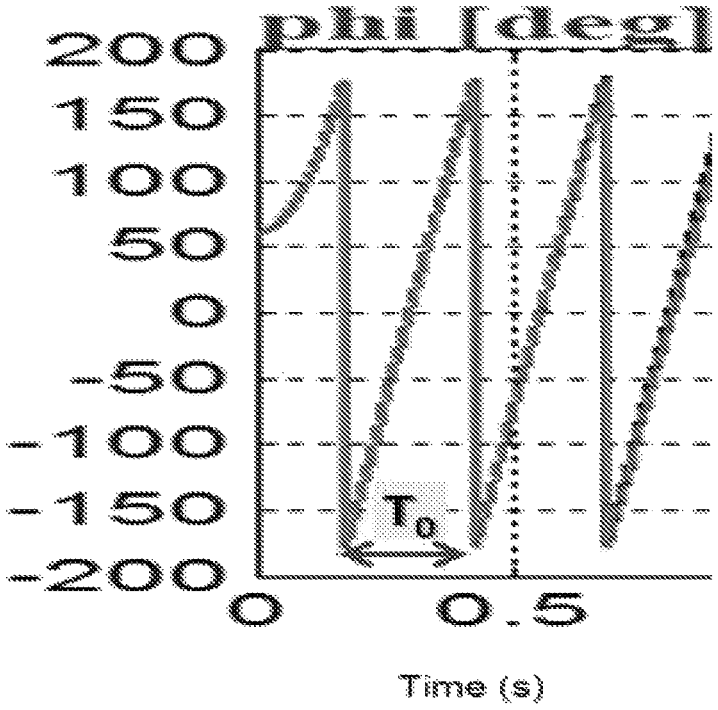
FIG. 6*a* is a graph demonstrating spin rate induced by a canister, according to some examples of the presently disclosed subject matter.

FIG. 6*a* is a graph demonstrating projectile spin rate created by spinning mechanism 240, according to some examples. The projectile in this example achieves a spin rate of about 5 Hertz where a full spin cycle ($T_c$) occurs every 200 msec. Notably, in order to obtain a deflection directivity, a thruster activation time period ($t_0$) is considerably smaller than the cycle period ($t_0 \ll T_c$). For example, $t_0$=50 milliseconds, and $T_c$=200 milliseconds. Thus, according to this example, while an activated thruster is producing the thrust, the projectile turns a quarter (90°) of the spinning cycle. Assuming an evenly distributed thrust profile (e.g., rectangular thrust profile), the thruster can be activated 450 before the deflection azimuth with burn-out occurring 450 after the deflection azimuth.

Figure 6B:
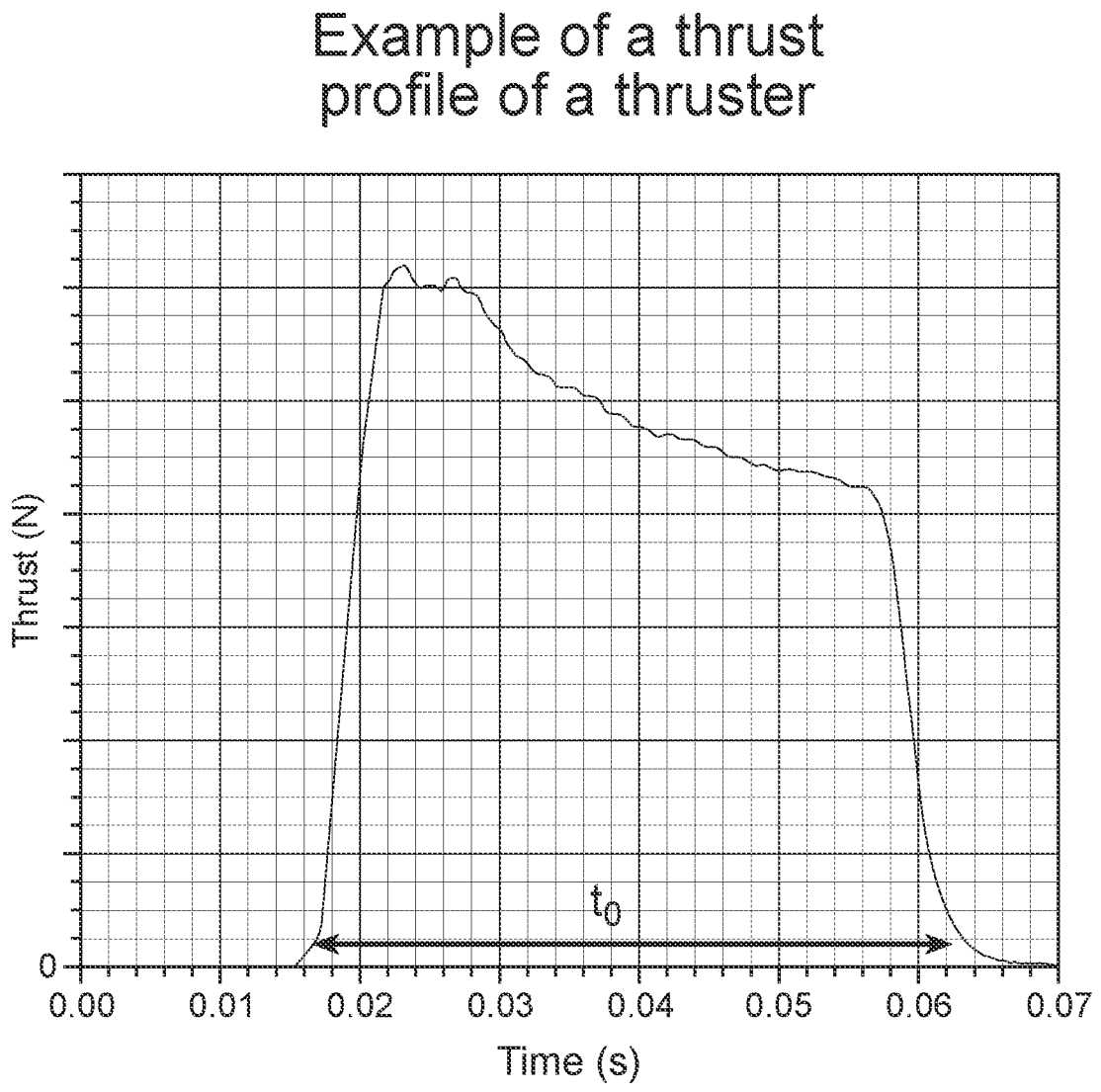
FIG. 6*b* is a graph demonstrating an uneven activation profile of a thruster, according to some examples of the presently disclosed subject matter.

As mentioned above, the activation timing is also dependent on the specific burning profile of the thruster. FIG. 6*b* is a graph showing an example of an uneven thrust profile of the thruster 105. In such cases, the burning time period to can be divided into two time periods $t_{01}$ and $t_{02}$, of different durations, where the total thrusts generated during both of the time periods are equal. According to this example, activation timing is selected such that the first time period ends when the azimuth of the thruster coincides with the desired deflection azimuth to thereby generate an averaged thrust vector that coincides with the deflection azimuth.

Reverting to the selection of an activation profile in FIG. 4*a*, each thruster(s) activation profile provides a corresponding deflection rate that produces a respective velocity deflection angle of the projectile relative to its initial launching direction, where the velocity vector deflection angle defines the final inclination of the projectile trajectory. Thus, given a direction and range to the target, a thruster(s) activation profile that would deflect the velocity vector of the projectile in an appropriate angle to provide a trajectory leading to the target, is selected.

According to some examples, launching sub-system 140 comprises, or is otherwise operatively connected, to thruster (s) activation profiles database. For example, an activation profile database can be stored in a computer data repository 224 that is accessible to control circuitry 210. To this end data repository 224 can include for example a NAND memory device comprised in, or operatively connected to, control circuitry 210. The activation database can be implemented for example as a lookup table of some sort ("deflection lookup table").

In some examples, the activation profile database maps each of a plurality of activation profiles to respective velocity deflection angles and/or range to a target. Thus, given the range to the target, the desired azimuth and elevation and velocity deflection angles can be calculated (onboard the projectile, or otherwise received prior to launch as part of the mission data). Based on this data, a suitable thruster(s) activation profile for deflecting the velocity vector of the projectile at a suitable angle is retrieved from the database. For example, launching control circuitry 210 can be configured, responsive to a launching command, to retrieve from the command the range to the target and retrieve from the database data indicative of an appropriate activation profile for deflecting the projectile to reach the target. The activation database is adapted to each type of projectile (e.g., missile) as the activation profile of the thruster is dependent on the specifics of the projectile, including its mass and lever arm, as further discussed below. An activation profiles database (e.g., formatted as a lookup table) can be generated based on simulation of a projectile flight including its thruster(s) activation, as is well known in the art.

As explained above, in some examples the projectile is ejected out of its cell while spinning around its longitudinal axis, while in other examples, only the thrusters-belt 150 attached to the projectile is spun around the longitudinal axis, while the projectile itself remains unspun. During the second burning phase, in each cycle (referred to herein as "activation spin-cycle" or simply "spin-cycle") the thrusters complete a full spin around the longitudinal axis of the projectile. During each cycle, a certain thruster is located at a certain moment at an activation azimuth that would generate thrust matching a certain deflection azimuth. Activation of a thruster at an earlier spin-cycle provides a longer period of time for deflecting the projectile's trajectory as compared to a later spin-cycle, and thus affects the resulting deflection angle. Activation of the thruster or combination of thrusters 105 at the same thruster activation azimuth, but at different spin-cycles, results in deflection of a projectile trajectory to the same azimuth, but at different trajectory deflection angles.

Assuming for example, a spin rate of 5 Hertz, where a full spin (cycle) occurs over a time period of 200 milliseconds. In case the second burning phase is 2 seconds long, this provides, for each thruster, about 10 possible spin-cycles suitable for thruster activation for generating thrust in the same thrust azimuth. Notably, the number of possible thruster activations in a desired azimuth is increased where more thrusters are installed in the thruster-belt 150. For example, in case a pair of thrusters are installed in the thrusters-belt 150, the number of possible thruster activations in the desired azimuth increases to 20 (each half period of the spin-cycle).

In some examples, each activation profile indicates the activation spin-cycle assigned to each thruster (possibly some thrusters may not be activated at all, e.g., would be assigned with a null spin-cycle). In case more than one thruster is available, the activation profile indicates, for a respective combination of thrusters, an activation sequence of the thrusters and the respective activation spin-cycle assigned to each thruster in the sequence.

Each activation profile specifies the activation timing for each thruster in a group containing one or more thrusters, where the activation timing is selected, as discussed above, according to a desired deflection azimuth and also according to the desired deflection rate of the velocity vector. An activation timing of one or more thrusters is synchronized to a specific spin-cycle in order to achieve a desired deflection rate for different periods of time.

Thus, in some examples, assuming only one thruster is available, a suitable activation profile is selected indicating a certain spin-cycle, according to a desired deflection angle of the velocity vector, and the activation timing of the thruster is calculated according to the desired deflection azimuth and thrust profile of the thruster 105. This is also true when a plurality of thrusters are activated together. In case more than one thruster is activated sequentially, the activation profile includes, in some examples, the activation timing of the thrusters other than the first (which is the product of the activation timing calculation as explained above) which can be defined relative to the timing of the first thruster activation (initial activation). For example, an activation profile can include the spin-cycle assigned for activating each of the thrusters following the first thruster.

In case where a plurality of thrusters are fixed to the projectile around its circumference ("thrusters-belt"), different combinations of thrusters from the plurality of thrusters can be activated together or sequentially. Each such combination provides different deflection rate values of the projectile body and its velocity vector, due to the combination of thrusting vectors of simultaneously activated thrusters. Thus, by selecting a specific combination of thrusters, it is possible to more accurately control the moments acting on the projectile body for creating the projectile body deflection rate, and, accordingly, more accurately controlling the deflecting angles of the projectile trajectory.

Figure 7:
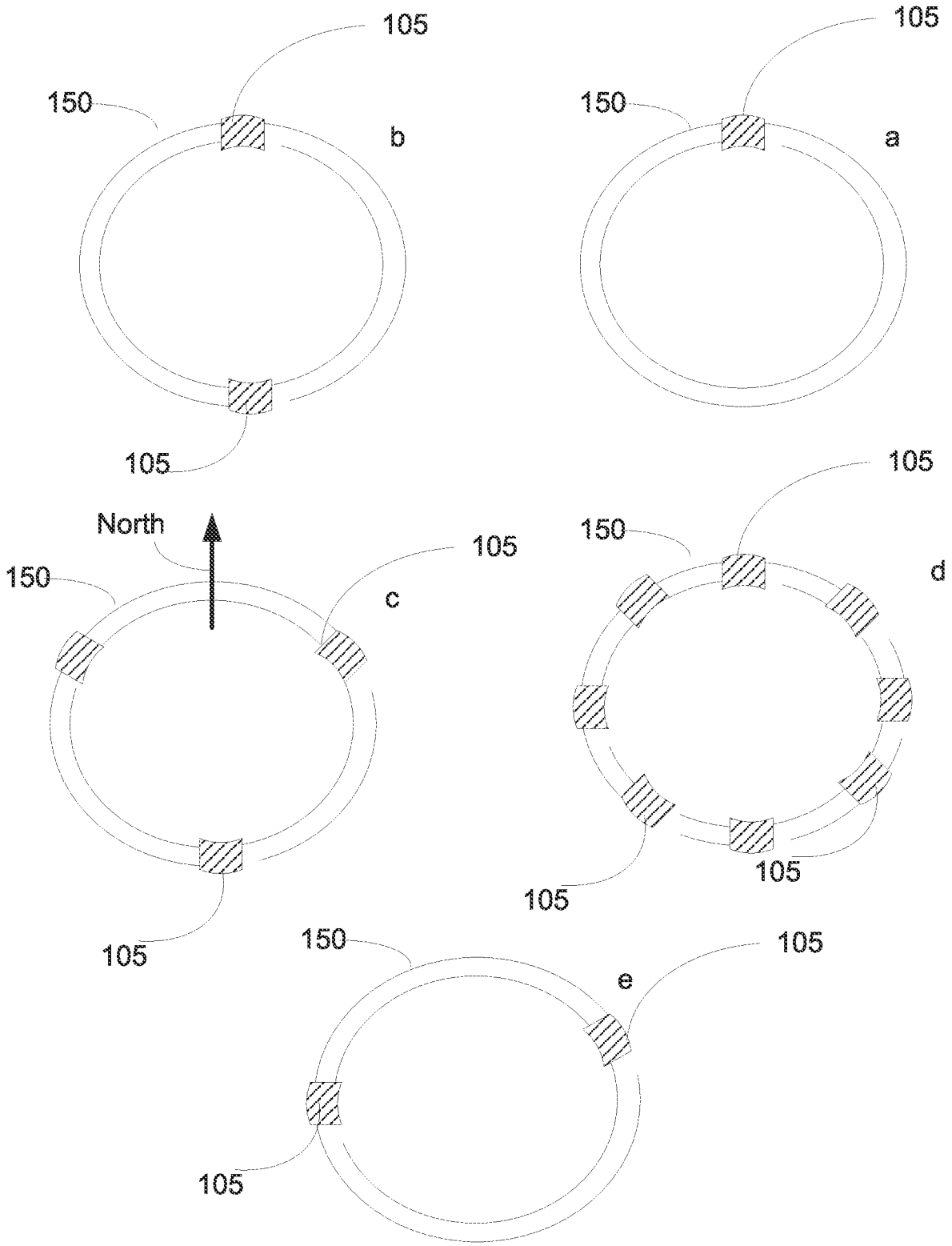
FIG. 7 is a schematic illustration of various thruster-belt configurations, according to some examples of the presently disclosed subject matter.

FIG. 7 is a schematic illustration showing in top view different examples of thruster-belts 150, according to examples of the presently disclosed subject matter. Each of the thruster-belts in the figure comprises a different number of thrusters. The thrusters are shown on the circumference of a projectile. In general, a greater number of thrusters provides a greater number of combinations, each combination providing a different thrust value. Thus, a greater number of thrusters increases the number of possibilities of activation, each possibility providing respective deflection rates of the projectile body and its velocity vector, and accordingly the resolution of the possible deflection angles of the projectile velocity vector at burn-out is increased, as well as the accuracy of deflection.

For example, where only one thruster is available, the projectile body deflection rate is dependent on the thrust generated by that thruster alone (along with the thruster level arm and the projectile moment of inertia). When two thrusters are fixed to the thruster-belt 150 as shown in item b in FIG. 7, this provides several possibilities of activation, including activation of only one of the two thrusters at any one of the plurality of the spin-cycles, or sequential activation of the two thrusters. In case the thrusters are fixed to the thrusters belt, e.g., as shown in item e in FIG. 7, simultaneous activation of the two thrusters is also possible. Notably, the number of combinations increases significantly when more than two thrusters are fixed to the thruster-belt 150. For example, item c in FIG. 7 shows a thruster belt with three thrusters, having activation profiles that include activation of each thrusters individually at any one of plurality of the spin-cycles; activation of any pair or all three thrusters sequentially; simultaneous activation of a pair of thrusters when the thrust vectors of the two thrusters are on both sides of the thrust azimuth in order to create a combined thrust vector that coincides with the thrust azimuth; and sequential activation of one thruster combined with simultaneous activation of a pair of thrusters, etc.

Figure 8A:
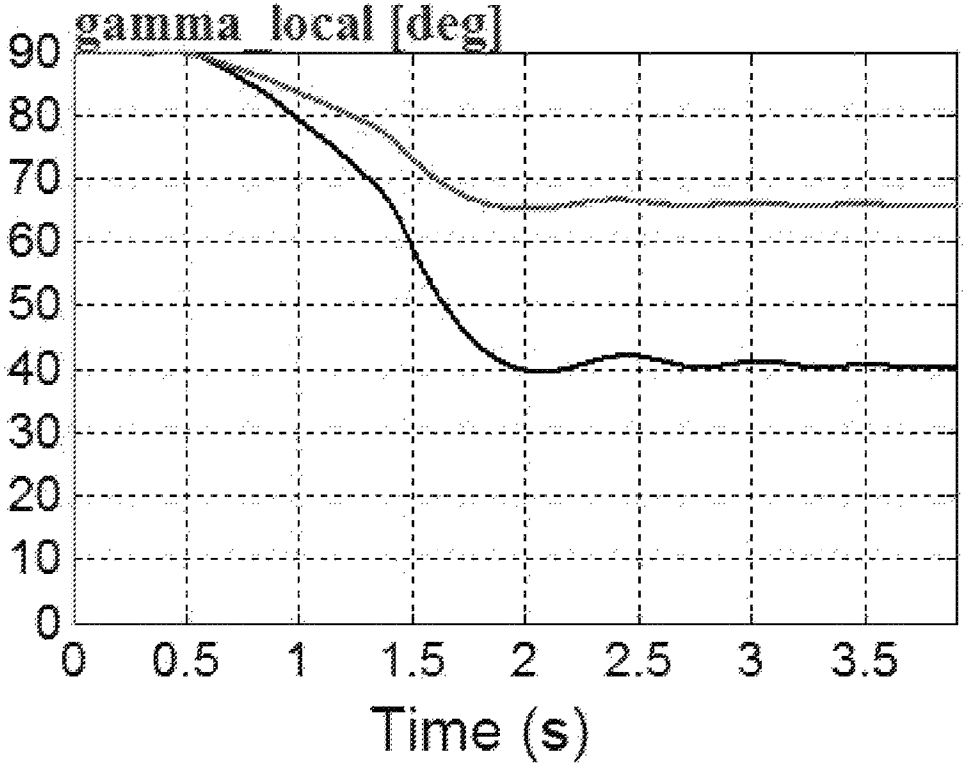
FIG. 8*a* is a graph showing comparison between deflection with a single thruster and deflection with two thrusters, according to some examples of the presently disclosed subject matter.

FIG. 8*a* is a graph showing an example of behavior of a projectile velocity vector deflection angle generated by a single thruster, compared to a projectile velocity vector deflection angle generated by adjusted activation of two thrusters installed in opposite directions on the projectile, each providing an average thrust vector in the same deflection azimuth. In the example of sequential activation of two thrusters (105), the second thruster is activated with delay of half spin-cycle relative to activation of the first thruster. As shown in the graph, the trajectory deflection angle generated by a single thruster is around 65°, while the trajectory deflection angle generated by two thrusters is around 40°.

Figure 8B:
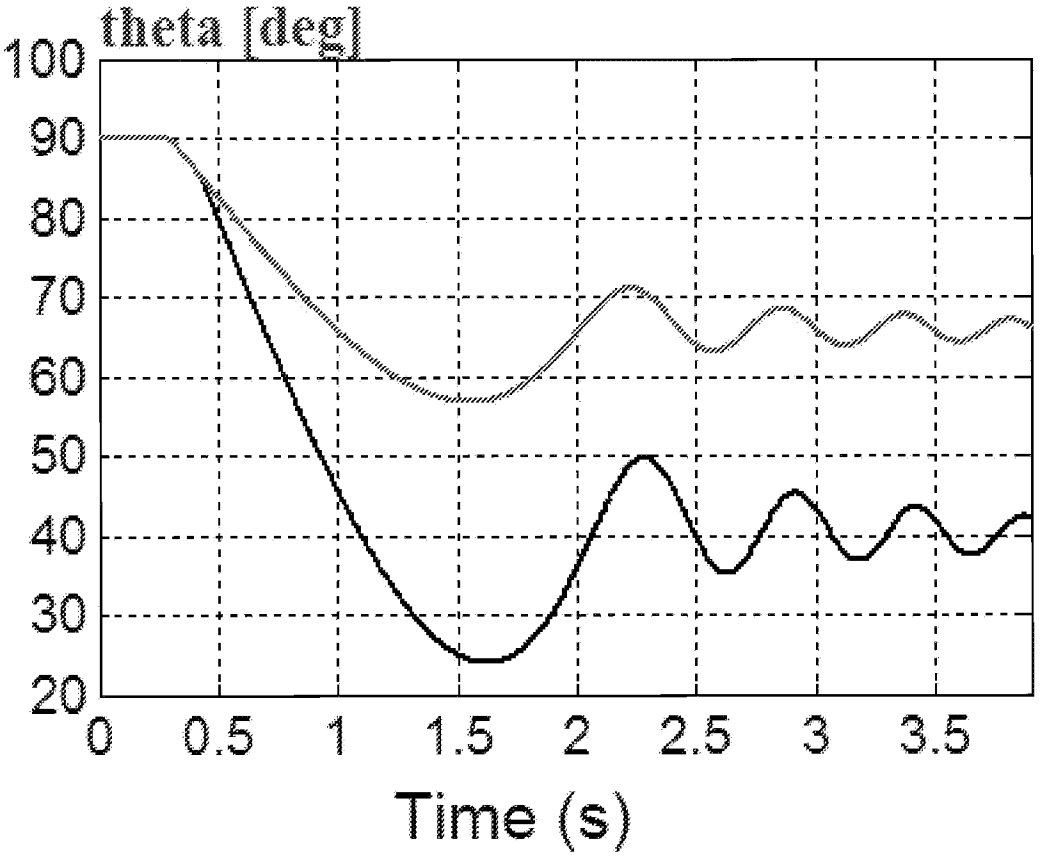
FIG. 8*b* is a graph showing an example of a swinging pitch angle of a projectile, according to some examples of the presently disclosed subject matter.

Effective deflection of the projectile trajectory occurs primarily from the time of thruster activation until the end of the second burning phase and beginning of the third burning phase, when the projectile accelerates and significant dynamic pressure is generated, thereby creating significant lift that opposes the deflection and stabilizes the deflection angle of the projectile trajectory. FIG. 8*b* is a graph demonstrating an example of swinging pitch angle of a projectile that experiences thrust and lift forces during deflection. The top line shows the behavior of a projectile generated by single thruster (105) activation, and the bottom line shows the behavior of a projectile generated by adjusted activation of two thrusters installed on the projectile in opposite directions, and providing an average thrust vector in the same deflection azimuth. Notably, due to the aerodynamic forces acting on a statically stable projectile during flight, the projectile naturally maintains the desired trajectory leading to the target, and its body attitude aligns with the velocity vector direction.

As mentioned above, activation of a thruster at an earlier spin-cycle provides a longer period of time for deflecting the projectile trajectory as compared to a later spin-cycle. This is further demonstrated in FIG. 9 which shows testing results in a graph plotting deflection angle as a function of the number of spin-cycles in which two thrusters were activated. The configuration of the thrusters is identical to the configuration of FIGS. 8*a* and 8*b* (two thrusters are installed in opposite directions on the projectile, but activated sequentially to deflect projectile trajectory to the same azimuth).

The bottom line in the graph shows about 50° deflection of the projectile's trajectory, from 90° at the launching to 40°, resulting from activation of two thrusters at the first spin-cycle during the second burning phase. The middle line shows about 40° deflection of the projectile trajectory from 90° at the launching to about 50°, resulting from activation of two thrusters at the second spin-cycle during the second burning phase. The top line shows about 30° deflection of projectile trajectory from 90° at the launching to 40°, resulting from activation of two thrusters at the third spin-cycle during the second burning phase. Accordingly, as shown, the same thruster can be activated at different spin-cycles, each spin-cycle prescribing a different deflection time period, resulting in deflection of projectile trajectory to different respective inclination angles. Thus, the resolution of activation profiles (representing a deflection angles grid) depends on the available activation combinations and the number of spin-cycles during the second burning phase.

Once a suitable activation profile has been determined, and the activation time (of the first thruster) has been calculated, one or more thrusters are activated in one or more activation spin-cycles. In response to activation of the thruster(s), the projectile trajectory is deflected at a desired deflection angle. Once the second burning phase is complete, the projectile trajectory assumes the desired deflection angle, and the third burning phase commences, where burning of the third part of the propellant generates thrust, providing acceleration for propelling the projectile in the direction of the target.

The following is an example of a calculation of the deflection angle which is a product of a certain activation profile.

Calculation of the initial pitch rate of a projectile:

$T_c$—The spin period (period of a spin-cycle) induced by the canister as also demonstrated above with reference to FIG. 6*a*.

$X_{cg}$ (t)—Center of gravity of a certain projectile as known in the art.

Figure 10:
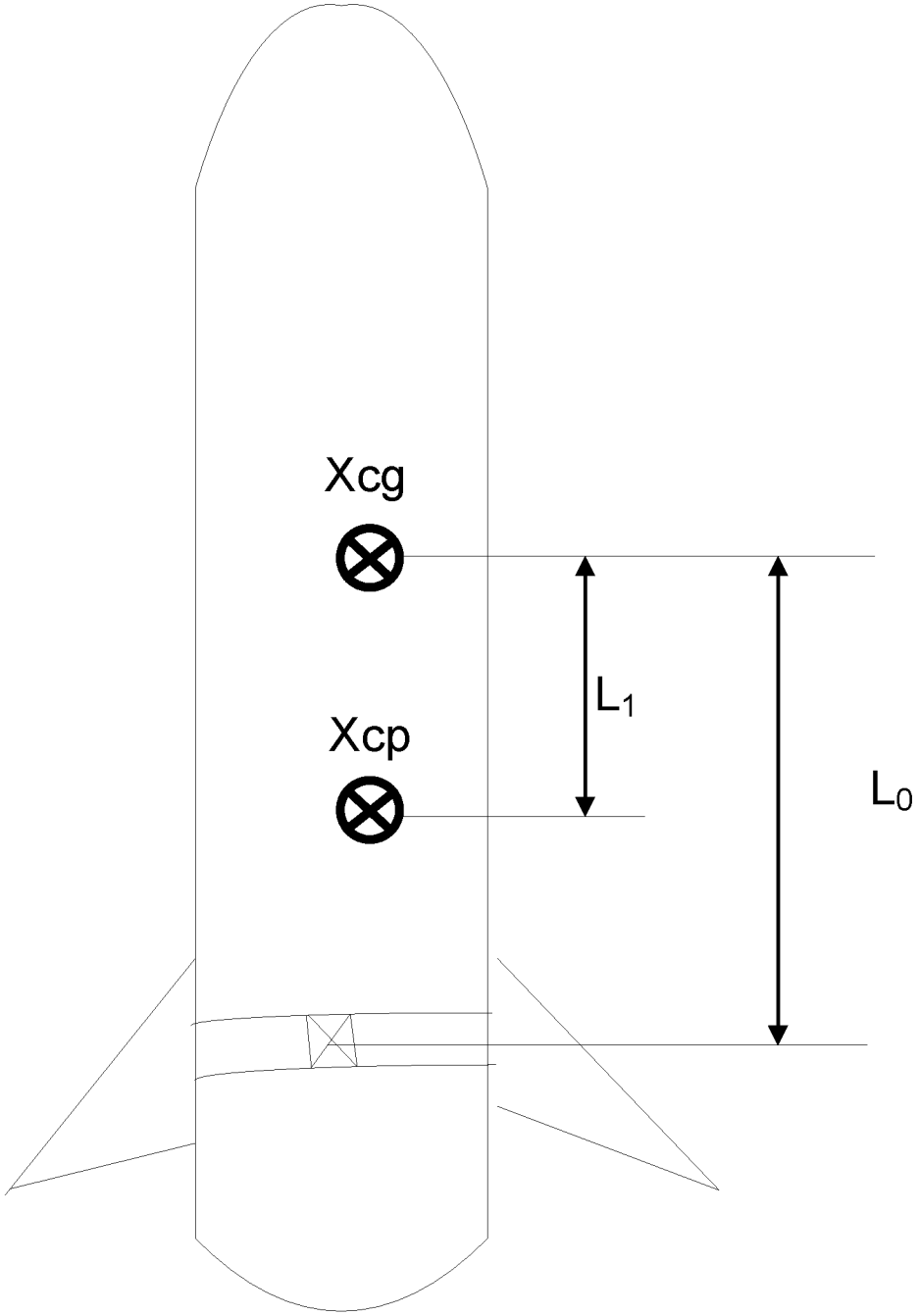
FIG. 10 is a general schematic illustration of a projectile demonstrating certain structural principles, according to some examples of the presently disclosed subject matter.

$L_0$(t)—Lever arm of thruster, which is defined as the distance between the nozzle of a thruster and the projectile center of gravity $X_{cg}$(t) at the moment of thruster activation (as shown in FIG. 10).

$I_{yy}$(t)—Moment of inertia of projectile as known in the art in pitch/yaw direction. Note that the value of $I_{yy}$ depends on the projectile body geometry and mass distribution.

$F_t$—Average thrust of the thruster to the desired azimuth.

$t_0$—duration of thruster(s) thrust ($t_0 << T_c$).

Equation (4) for calculating the initial pitch rate upon thruster activation (assuming aerodynamic forces can be ignored at the beginning of the missile flight due to relatively low velocity, and gyroscopic effect is negligible due to low spin rate of the projectile):

$$\dot{\theta}_{in} = \int_0^{\tau_0} \frac{L_0 F_t}{I_{yy}} dt$$

For example, for:

$L_0$=2, $F_t$=1000N, $I_{yy}$=100 kg*m$^2$, and $t_0$=50 milliseconds, the calculated pitch rate a is 1 radians per second.

As explained above, during trajectory shaping, different forces are applied onto the projectile. The following is an example of projectile kinematics calculation that takes into account these forces.

The following are a set of simplified equations for projectile velocity calculation during trajectory shaping (assuming aerodynamic damping forces and jet damping forces can be ignored).

$$V_z = V_0 + \int_{t_0}^{t_1} [(a_t(t) - a_{dr}) * \sin\theta - a_{lift} * \cos\theta - g] dt \quad \text{Equation 5:}$$

$$V_x = \int_{t_0}^{t_1} [(a_t(t) - a_{dr}) * \cos\theta + a_{lift} * \sin\theta] dt \quad \text{Equation 6:}$$

where:

$V_0$—The projectile's initial velocity resulting from acceleration of a projectile by the booster engine prior to activation of the thruster.

$a_{dr}(Q,a)$—Deceleration of projectile due to aerodynamic drag, where: $\alpha$ is projectile angle of attack; $Q=\frac{1}{2}\rho V^2$ is dynamic pressure, p is air density and V is projectile velocity.

$a_{lift}(Q,a)$—Normal acceleration of projectile due to aerodynamic lift $a_t(t)$—Acceleration due to rocket-engine thrust $t_1$—Duration of trajectory shaping $t_0$—Time of trajectory shaping beginning (see equation 4)

$\theta(t)$—Projectile attitude relative to launch pad (e.g., $\theta(0)=90°$ in case of launch from VLS)

A trajectory angle ($\gamma$) is defined by following equation (7):

$$\gamma = a\tan\frac{V_z}{V_x}$$

The angular position of the projectile body is defined by following equation (8):

$$\theta = \int_{t_0}^{t_1} \left[ \dot{\theta}_{in} - \int_{t_0}^{t_1} a_{lift} * L_1(t) * \frac{m_{projectile}(t)}{I_{yy}(t)} dt \right] dt$$

where $\dot{\theta}_{in}$ is an initial pitch rate defined by equation 4, $X_{cp}(M,\alpha)$—The projectile's body center of pressure depends on Mach number and angle of attack ($\alpha$), as is well known in the art.

$L_1$—Aerodynamic force lever arm (distance between $X_{cg}$ and $X_{cp}$ as shown in FIG. 10).

$m_{projectile}$ is a projectile mass.

An angle of attack of the projectile defined by the following equation 9:

$$\alpha = \theta - \gamma$$

These equations take into consideration variations in parameters during projectile shaping, including changes in mass, moment of inertia, and lever arm of the projectile, resulting in changes in mass distribution due to burning of the propellant.

The calculations described above can be used for determining the trajectory angle ($\gamma$) deflections provided by different thrusters activation profiles, and for generating a deflection lookup table to be used during missile launch, as described above.

FIG. 4*b* is another flowchart of operations carried out for providing desired deflection angle rate and deflection azimuth, according to some examples of the presently disclosed subject matter.

The operations described with reference to FIG. 4*b* include real-time calculation of activation timing based on real-time feedback.

As explained above with reference to blocks 403 and 405 in FIG. 4*a*, according to some examples, the initial activation time of a first thruster is calculated, and the timing of activation of additional thrusters can be determined according to a selected activation profile, relative to activation of the first thruster.

However, in some cases, the actual result of activation of one or more deflection thrusters 105 is different from that which was intended, resulting in a deviation from the desired deflection azimuth and/or deflection angle rate. Factors that may influence the projectile deflection include:

a) Friction with the canister, variation of booster ignition time, variation of thrust in the first burning phase etc. may influence ejection velocity, and, as a result, initial projectile/thruster spin rate.

b) Winds, misalignment between thrust vector and center of gravity, tip-off phenomenon etc. provide parasitic moments acting on the projectile, and, as a result, parasitic angle rates of a projectile.

c) Deviation in a thrust profile of a thruster also can contribute to deviations in a deflection azimuth and deflection angle rate.

Accordingly, in order to achieve a more accurate deflection of the projectile, control system 100 (e.g., by navigation subsystem 110) of a projectile should track the real attitude of a projectile, and activate additional thrusters (e.g., second, third, fourth, etc.) in an updated timing that takes into account also the actually achieved deflection rate and deflection azimuth. According to some examples, launching control circuitry 210 is configured, following initial activation of the first thruster, to determine the effect of one or more previous activations of thrusters, as well as ambient conditions, on the projectile orientation. To this end, control circuitry can use information including real-time measurements (obtained, for example, from an onboard IMU) relating to the projectile state, including projectile spin rate, achieved (current) deflection azimuth, and deflection angle rate, as well as information on remaining thrusters available for activation, and their angular position (azimuth). Based on this information, control circuitry 210 can determine whether adaption of the activation profile is needed in order to rectify any deviation in the real-time orientation from the desired orientation.

In case a difference between the measured real-time orientation and the desired orientation of the projectile is detected, the thrusters' activation parameters of one or more thrusters is adapted in real-time in order to rectify this deviation. A selected activation profile can be updated, e.g., by changing the number of thrusters which are activated (adding or removing thrusters) and/or the activation time of different thrusters (e.g., changing the respective spin cycle of activation). For example, an additional one or more thrusters, previously not intended to be activated, can be activated for the purpose of deflecting the projectile in a direction opposite to the direction in which it excessively turned. In another example, the activation timing of a thruster can be adapted such that the thrust vector of thruster 105 is changed so it rectifies the deviation in the deflection azimuth. In yet a further example, in case of a deflection angle rate that is greater than a desired value, an intended activation of an additional thruster can be cancelled or otherwise delayed to a later activation spin-cycle, in order to reduce further increase in the deflection angle rate.

Thus, according to some examples, during the second burning phase, after the initial activation of the first thruster (block 4051), data related to the projectile state is continuously measured in real-time (block 4053) and compared to the desired state of the projectile. Specifically, real-time deflection azimuth and/or deflection angle rate are compared to desired deflection azimuth and deflection angle rate, to determine whether there exists any discrepancy between the observed (measured) and expected values (block 4055). Real-time deflection azimuth and deflection angle rate can be determined based on the initial azimuth of one or more thrusters (at the beginning of the second burning phase) and the angular and linear location and velocity which can be determined by an onboard Inertial Measurement Unit (IMU) which comprises accelerometers, and therefore provides more accurate results.

If a difference is found, processing circuitry 210 calculates, based on the difference and the available thrusters, an adaptation of the thrusters' activation sequence (updates the activation profile) that would rectify the deviation and provide the desired deflection azimuth and/or deflection angle rate (block 4057). Then, one or more thrusters are activated according to the calculation, for the purpose of rectifying the detected deviation in deflection azimuth and deflection angle rate (block 4059). This process can be repeated during trajectory shaping in a closed feedback loop in order to obtain more accurate results adapted to real-time conditions.

It is also to be understood that the presently disclosed subject matter is not limited in its application to the details set forth in the description contained herein or illustrated in the drawings. The presently disclosed subject matter is capable of other embodiments and of being practiced and carried out in various ways. Hence, it is to be understood that the phraseology and terminology employed herein are for the purpose of description and should not be regarded as limiting. As such, those skilled in the art will appreciate that the conception upon which this disclosure is based may readily be utilized as a basis for designing other structures, methods, and systems for carrying out the several purposes of the present presently disclosed subject matter.

The invention claimed is:

1. A system for launching a projectile towards a target, the system comprising:

a control circuitry;

a booster engine; and one or more thrusters adapted to be connected to the projectile and capable of being spun during launch around a longitudinal axis of the projectile, the control circuitry being operatively connected to the one or more thrusters;

wherein the booster engine is configured such that ignition of propellant stowed in a combustion chamber of the booster engine, initiates a sequential execution of a first burning phase, a second burning phase and a third burning phase of the propellant; wherein during the first burning phase the projectile is ejected from a cell and wherein thrust generated by burning of the propellant during the second burning phase is lower than the thrust generated during the first and the third burning phases;

wherein the control circuitry is configured to activate during the second burning phase the one or more thrusters; wherein upon the activation, the projectile begins to turn in a certain deflection azimuth that is dependent on activation timing.

2. The system of claim 1, wherein during the first burning phase the projectile is ejected from the cell and the one or more thrusters are spun around a longitudinal axis of the projectile; wherein the control circuitry is configured to activate the one or more thrusters according to the activation timing, wherein the activation timing is calculated according to a desired deflection azimuth.

3. The system of claim 1, wherein activation of the one or more thrusters is executed according to a selected activation profile, wherein the activation profile is selected according to a desired deflection angle of a velocity vector of the projectile.

4. The system of claim 3, wherein the activation profile comprises data indicating, for each one of the one or more thrusters, a respective spin-cycle for activation.

5. The system of claim 3, wherein the activation profile defines for a specific combination of one or more thrusters, activation timing of each thruster relative to activation timing of a first thruster.

6. The system of claim 2, wherein the control circuitry is configured to calculate the activation timing of the one or more thrusters, based on data including: initial angular position of at least one thruster, spin rate and a position of the target.

7. The system of claim 1, wherein the one or more thrusters include two or more thrusters and wherein the control circuitry is further configured, following activation of a first thruster, to update a respective activation timing of one or more additional thrusters, according to the actual deflection azimuth and deflection angle rate, resulting from one or more previous activations of thrusters.

8. The system of claim 2, further comprises an off-board processing circuitry, external to the projectile, configured to calculate an activation timing of at least one thruster of the one or more thrusters, based on data including: direction of the target, nominal spin rate of the projectile and nominal thrust of the one or more thrusters.

9. The system of claim 2, wherein the cell is designed with a spiral groove along its internal surface and the projectile comprises a pin attached to its body; wherein the projectile is stored in the cell with the pin positioned within the groove and upon launch, the projectile is pushed out of the cell while the pin situated in the groove causing the projectile to spin around its longitudinal axis.

10. The system of claim 2, wherein the one or more thrusters are installed in a thrusters-belt fixed to the projectile in a manner allowing the belt to spin freely around the projectile and wherein spinning of the belt is executed by any one of:

a. an onboard spinning mechanism operatively connected to the belt; or b. a pin attached to the belt which is situated within a spiral grooved disposed along an internal surface of the cell, wherein upon launch, the projectile is pushed out of the cell and the pin and the spiral groove cause the belt to spin around its longitudinal axis.

11. The system of claim 1, wherein thrust generated during the second burning phase is at least two times lower than the thrust of the first burning phase.

12. The system of claim 1, wherein a duration of thrust generated by any one of the one or more thrusters is shorter than a duration of a thruster spin-cycle.

13. The system of claim 1, wherein the one or more thrusters comprise a plurality of thrusters and wherein the control circuitry is further configured following activation of a first thruster of the plurality of thrusters to:

measure real-time data including deflection azimuth and/or deflection angle rate; compare the measured real-time data with an expected data; in case a deviation between measured data and expected data is identified, update thruster activation parameters to rectify the deviation.

14. A method of launching a projectile towards a target, the method comprising:

in response to a command to launch the projectile towards the target:

igniting propellant stowed in a combustion chamber of the projectile; wherein ignition of the propellant initiates a sequential execution of a first burning phase, a second burning phase and a third burning phase of the propellant; wherein during the first burning phase the projectile is ejected from a cell and wherein thrust generated by burning of the propellant during the second burning phase is lower than the thrust generated during the first burning phase and the third burning phases;

ejecting, during the first burning phase, the projectile out of a cell in a manner that causes one or more thrusters fixed to the projectile, to spin around a longitudinal axis of the projectile;

activating, during the second burning phase, the one or more thrusters; wherein the one or more thrusters are fixed to the projectile, such that upon an activation of the one or more thrusters, the projectile begins to turn in a certain deflection azimuth according to activation timing.

15. The method of claim 14 further comprising, activating the one or more thrusters according to the activation timing, wherein the activation timing is calculated according to a desired deflection azimuth.

16. The method of claim 14 further comprising: selecting an activation profile according to a desired deflection angle of velocity vector of the projectile; and activating the one or more thrusters according to the selected activation profile.

17. The method of claim 16, wherein the activation profile defines for a specific combination of one or more thrusters an activation timing of each thruster relative to the activation timing of a first thruster.

18. The method of claim 15, further comprising: calculating the activation timing of the one or more thrusters, based on data including: an initial angular position of at least one thruster, spin rate of the projectile and a position of the target.

19. The method of claim 14, wherein the one or more thrusters include two or more thrusters and wherein the method further comprising:

following activation of a first thruster, updating a respective activation timing of one or more additional thrusters, according to the actual deflection azimuth and deflection angle rate, resulting from one or more previous activations of one or more thrusters.

20. The method of claim 15, further comprising: maintaining the projectile in the cell having a spiral groove along its internal surface while a pin attached to a body of the projectile is positioned within the groove, thereby causing the projectile to spin around its longitudinal axis upon launch.

21. The method of claim 14, wherein the projectile includes a thrusters-belt comprising the one or more thrusters being fixed to the projectile in a manner allowing the belt to spin freely around the projectile separate from projectile's body, the method further comprising:

maintaining the projectile in the cell having a spiral groove along its internal surface while a pin attached to a body of the projectile is positioned within the groove, thereby causing the belt to spin around its longitudinal axis upon launch.

22. The method of claim 15, wherein the one or more thrusters are installed in a thrusters-belt fixed to the projectile in a manner allowing the belt to spin freely around the projectile separate from a projectile body; the method further comprising: activating a spinning mechanism onboard the projectile operatively connected to the belt thereby causing the belt to spin.

23. The method of claim 14, wherein a duration of thrust generated by any one of the one or more thrusters is shorter than a duration of a thruster spin-cycle.

24. The method of claim 14, wherein one or more thrusters comprise a plurality of thrusters, the method further comprising following activation of a first thruster of the plurality of thrusters:

measuring real-time data including deflection azimuth and/or deflection angel rate;

comparing the measured real-time data with an expected data; and in case a deviation between measured data and expected data is identified, updating thruster activation parameters to rectify the deviation.

25. A projectile, comprising:

a control circuitry;

a booster engine; and one or more thrusters adapted to be connected to the projectile and capable of being spun during launch around a longitudinal axis of the projectile, the control circuitry being operatively connected to the one or more thrusters;

wherein the booster engine is configured such that ignition of propellant stowed in a combustion chamber of the booster engine, initiates a sequential execution of a first burning phase, a second burning phase and a third burning phase of the propellant; wherein during the first burning phase the projectile is ejected from a cell and wherein thrust generated by burning of the propellant during the second burning phase is lower than the thrust generated during the first and the third burning phases;

wherein the control circuitry is configured to activate during the second burning phase the one or more thrusters; wherein upon the activation the projectile begins to turn in a certain deflection azimuth that is dependent on a timing of activation.

26. A statically stable projectile comprising the system according to claim 1.

* * * * *